United States Patent [19]

Bricmont

[11] 3,990,836

[45] Nov. 9, 1976

[54] HEARTH CLEANING APPARATUS

[75] Inventor: Francis H. Bricmont, Pittsburgh, Pa.

[73] Assignee: Bricmont & Associates, Inc., Pittsburgh, Pa.

[22] Filed: May 5, 1975

[21] Appl. No.: 574,517

[52] U.S. Cl. ..... 432/75; 432/139; 432/2; 15/104.07; 15/93 R

[51] Int. Cl.[2] ..... F27D 23/00

[58] Field of Search ..... 432/2, 75, 139, 50, 432/67, 74; 15/104.07, 93 R

[56] References Cited

UNITED STATES PATENTS

| | | | |
|---|---|---|---|
| 319,270 | 6/1885 | Lanyon | 432/2 |
| 1,567,554 | 12/1925 | Stevens et al. | 15/104.07 |
| 2,172,119 | 9/1939 | Boehler | 15/104.07 |
| 2,176,238 | 10/1939 | Anderson | 15/104.07 |
| 2,967,316 | 1/1961 | Kandle | 15/104.01 R |
| 3,074,090 | 1/1963 | Thompson | 15/93 R |
| 3,251,629 | 5/1966 | Cawley | 15/93 R |
| 3,258,255 | 6/1966 | Tippmann | 432/74 |
| 3,302,976 | 2/1967 | Grant | 15/104.07 |
| 3,471,888 | 10/1969 | Grant et al. | 15/104.07 |
| 3,667,743 | 6/1972 | Kovalcik | 432/139 |

FOREIGN PATENTS OR APPLICATIONS

| | | | |
|---|---|---|---|
| 514,261 | 2/1955 | Italy | 15/104.07 |

*Primary Examiner*—John J. Camby
*Assistant Examiner*—Henry C. Yuen
*Attorney, Agent, or Firm*—Brown, Murray, Flick & Peckham

[57] ABSTRACT

A hearth cleaning apparatus includes a wheeled car movable along a floor at the side wall of a reheat furnace wherein metallic workpieces are heated while they are advanced along the furnace hearth. The car is latched to the side wall of the furnace at any one of the normally-closed openings therein. An inverted U-shaped spacer slab is passed through the furnace between two workpieces for access to the hearth. An elongated digging bar which may be cooled by the internal flow of water is supported by the car and advanced through an opening in the side wall of the furnace to engage and loosen slag or other materials adhered to the soaking hearth while exposed by the spacer slab. The car includes a vernier elevation adjustment for the digging bar at the point of support adjacent the furnace and a course elevation adjustment for the digging bar at the opposite end of the car. The digging bar is propelled along the furnace hearth by a pair of pinch rolls. An eccentrically-pointed end on the digging bar is rotated by skewing one of the pinch rolls. A pneumatic hammer is releasably coupled by a gripper arm at any desired location along the digging bar. A position control piston and cylinder assembly moves the pneumatic hammer along the car with the digging bar and retracts the pneumatic hammer relative to the digging bar at the end of the stroke of the position control piston and cylinder assembly.

35 Claims, 13 Drawing Figures

HEARTH CLEANING APPARATUS

BACKGROUND OF THE INVENTION

This invention relates to an apparatus for removing adhered slag or other foreign materials that adhere to the refractory material forming a soaking hearth in a reheat furnace for metallic workpieces, and more particularly, the present invention provides an apparatus for removing adhered slag and the like from a furnace hearth during operation of the furnace by providing a car adapted to move along the floor at a side wall of the furnace while carrying a digging bar that is coupled to a pneumatic hammer or the like for delivering a digging force to the bar while it extends through an opening in the side wall of the furnace to engage and lossen adhered slag on the hearth.

Reheating furnaces are commonly employed to heat billets, blooms, slabs and similar workpieces to temperatures up to 2400° F. Furnaces built generally before 1950 were designed with refractory hearths that were up to 25 feet wide, however since that time, the width of the workpiece supporting hearths has been increased up to about 42 feet maximum. The metallic workpieces are advanced through the furnace in a side-by-side relation either by a pusher at one end of the furnace or by means of walking beams within the furnace.

In present-day reheat furnaces, the workpieces enter through a charging door at one end of the furnace and first pass into a preheat zone from where the workpieces are advanced into a heating zone. Frequently, the outer surfaces of the workpieces become overheated or "superheated" in the heating zone before they are advanced into a soaking zone where a solid hearth made of refractory material provides continuous support for the workpieces. As the workpieces enter the soaking zone of the furnace, the superheated state of the adhered slag which includes scale and the like is semiplastic. The slag is transferred from the bottom surface of the workpiece to the hearth. The released slag from the workpiece solidifies and accumulates because the hearth is usually relatively cooler than the surface temperature of the workpiece when it enters the soaking zone. As the workpieces pass from the soaking zone they usually travel along a downwardly-inclined discharge chute and pass from an opening normally closed by a discharge door onto a roller table for conveying the workpiece to the rolling mill or the like. Some present-day reheat furnaces require a mechanical extractor to lift and remove a heated workpiece from the soaking zone and deposit it upon a roller table.

Prior to the time when the workpiece leaves the soaking zone, there is a tendency for scale and slag to be again transferred from the heated workpiece onto the hearth. The build-up of slag at the point where the workpieces enter the soaking zone and exit from the soaking zone creates acute operational problems in regard to irregular or unpredictable movements of the workpieces. If slag is allowed to accumulate on the hearth at the point where a workpiece enters the soaking zone, the forward edge of the workpiece is lifted and may be deflected upwardly. When this occurs, the workpiece is either pushed on top of the workpiece ahead of it or the workpiece rotates and stands on its side edge. In either event, the soak zone roof or drop-out area of the furnace is usually damaged. Repairs are costly and very time-consuming because operation of the furnace must be discontinued. A workpiece has actually penetrated through the furnace roof due to accumulated slag. The "soak zone nose" is that part of the furnace roof that forms a narrow entranceway into the soaking zone.

A water-cooled lintel as well as a furnace door located below it in the end wall of the furnace are particularly susceptible to damage when a workpiece fails to properly enter onto the downwardly-inclined skids at the discharge side of the soaking zone. Damage to the furnace, particularly the lintel, frequently occurs when two workpieces slide down the skids one on top of the other which is a condition caused by adhered slag on the hearth of the entrance to the soaking zone. Erratic movements of the workpieces at the discharge side of the soaking zone are attributed to the fact that there is an abrupt change to the plane of support for a workpiece when it passes from the hearth onto the inclined skids. At the transition area of support, the heated slag on the bottom of the workpiece is scraped loose and adheres to the hearth. As each workpiece slides over the adhered slag, more slag is released and adheres to the hearth. Some of the slag breaks loose causing the erratic movement of the workpieces. For example, a workpiece may slide down the skids upon an edge instead of its bottom surface. Thus, in order to avoid damage to the structure forming the reheat furnace, it is necessary to periodically remove adhered slag from the hearth in the workpiece drop-out zone as well as the other workpiece support surfaces throughout the furnace so as to assure proper movement of the workpieces through the furnace.

It is not practical or feasible to discontinue operation of the reheat furnace to carry out such cleaning operations because if the adhered slag is allowed to cool down to an ambient temperature, the slag becomes so hard that it is virtually impossible to break it loose without damaging the refractory material of the hearth. In this respect, the slag may take the form of iron silicate having a melting temperature of about 2200° F and forms a very tight adhesive bond to the refractory material of the hearth.

In the past, it was proposed to clean slag from a furnace hearth by employing a cleaning slab such as disclosed in U.S. Pat. No. 2,132,591. The cleaning slab which took the form of an inverted U-shaped member, was placed on the entry table at the charging side of the furnace so that it was advanced through the furnace between two adjacent workpieces. As the cleaning slab passed over the hearth, it was intended that plow-like edges on legs of the cleaning slab would scrape along the top surface of the hearth to thereby loosen the accumulated slag or cinders which were then either removed through the side opening in the cleaning slab or carried through the furnace to the discharge side of the furnace.

The proposed use of such a cleaning slab has the apparent advantage that it eliminates downtime of the furnace because the cleaning operation is carried out while the furnace continues its normal operation. However, adhered slag cannot be effectively loosened for removal by the cleaning slab without first manually digging the slag loose. The cleaning slab suffers from certain other acute disadvantages which the present invention is designed to overcome. Specifically, for example, the apparatus of the present invention is designed for control by an operator so that the cleaning process is not dependent upon unpredictable movements of workpieces through the furnace. In this regard, should the cleaning slab "dig" into the slag at one side of the furnace but not the other side, then the cleaning slab may be expelled from its intended location between two adjacent workpieces under the developed or applied force by a pusher at one end of the furnace. Moreover, it is virtually impossible to control the depth of penetration by such a cleaning slab into the slag. Usually the slab simply rides or passes over the slag or other material that builds up on the hearth. It is a likely possibility that the cleaning slab will dig into the refractory material of the hearth and damage it while moving along the furnace.

SUMMARY OF THE INVENTION

It is an object of the present invention to provide an improved hearth cleaning apparatus adapted for controlled mechanical removal of adhered slag from the workpiece support surface in a reheat furnace without disrupting the normal operation thereof.

It is another object of the present invention to provide an improved hearth cleaning apparatus which is controlled by an operator and includes a car for supporting controllable means to develop a digging force upon a digging bar adapted to extend through one of a number of normally-closed openings in a side wall of the furnace into an engaging relation with slag which is exposed by a spacer member arranged between two adjacent workpieces in a furnace.

It is a further object of the present invention to provide an improved hearth cleaning apparatus including a car adapted to support and position in an accurately controlled manner a digging bar while at the same time transmitting to the digging bar a desired force to loosen adhered slag from the hearth of the furnace during operation thereof.

It is a still further object of the present invention to provide an improved apparatus for removing slag adhered to a workpiece support surface of a furnace which apparatus includes a digging bar having an internal passageway for the circulation of cooling water to retain the desired physical properties of the digging bar while exposed to the operating temperatures developed within a heating furnace.

It is still another object of the present invention to provide an improved apparatus for releasing adhered slag from the hearth of a reheat furnace by providing a digging bar having an internal passageway for passing cooling water to openings at its working end for discharging such coolant water onto adhered slag to thereby facilitate loosening of the slag due to thermal cracking while applying a digging force to the slag.

More specifically, according to the present invention, there is provided a hearth cleaning apparatus for removing slag and the like adhered to the workpiece support surface of a furnace hearth used for side-by-side support of elongated metallic workpieces while advancing through the furnace to undergo heating. The furnace includes door members normally closing spaced-apart openings in the side walls of the furnace adjacent the hearth thereof. The cleaning apparatus includes, in combination, an elongated digging bar adapted to extend through an opening in the side wall of the furnace for contact with adhered slag on the hearth, a movable car adapted for latching to the side wall of the furnace to support the digging bar while extending through an opening in the side wall into the furnace, and impact means carried by the car and coupled to the digging bar for delivering a propelling force to the digging bar to mechanically loosen slag adhered to a workpiece support surface of the furnace.

In the preferred form of the present invention, the hearth cleaning apparatus further includes one or more means for adjusting the approach angle by the digging bar to the workpiece support surface of the furnace. In one aspect, there is provided a vernier adjustment for elevation control of the digging bar adjacent the side wall of the furnace and remote thereto, there is a course elevation adjustment for the digging bar. In another aspect, the digging bar has an eccentrically, cone-shaped end that is rotated by a skewed pinch roll while cooperating with a second pinch roll to advance the digging bar along the furnace hearth in a manner to vary the attack angle of the bar. The digging bar has an internal passageway for water to cool the digging bar which may further include openings at the slag engaging end thereof for discharging the coolant water onto adhered slag to crack the slag due to the differential thermal expansion and facilitate mechanical loosening of the slag by the digging bar.

The hearth cleaning apparatus may additionally include a T-shaped frame arranged so that an operator can position himself adjacent the central tongue of the frame to thereby more closely observe the movements of the digging bar and to exercise control over the digging operation. Wheels are used to support the car in a manner such that it can be moved along the floor at a side wall of the furnace and latched thereto at an inspection door opening. The digging bar is coupled by a clamping arm to impact means such as a pneumatic hammer to provide the desired digging force. The impact means is positioned by a piston and cylinder assembly so that as the digging bar is extended into the furnace, an operative relation is maintained with the clamping arm.

These features and advantages of the present invention as well as others will be more clearly understood when the following description is read in light of the accompanying drawings, in which.

Figure 8:
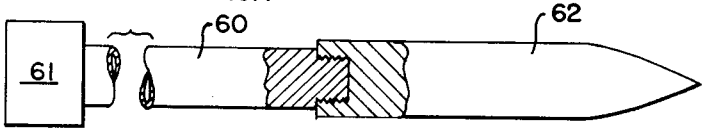
Figure 9:
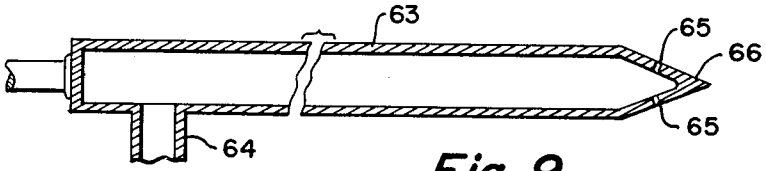
Figure 10:
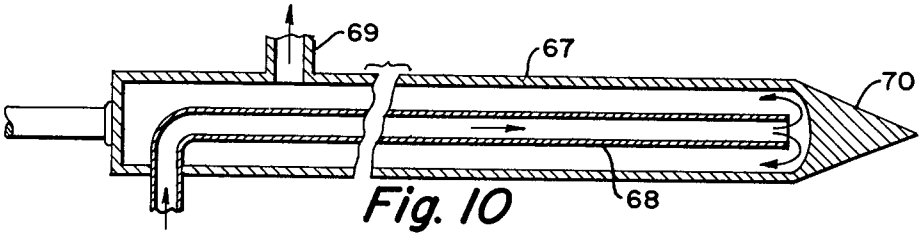
Figure 13:
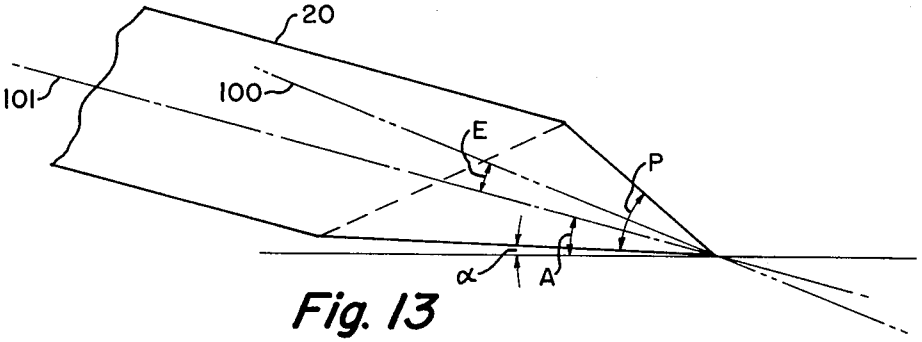
Figure 11:
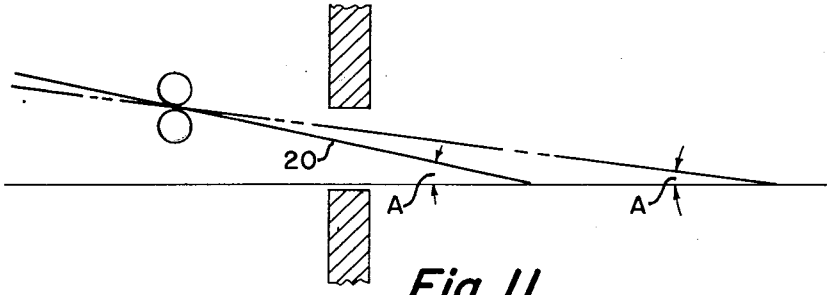
Figure 12:
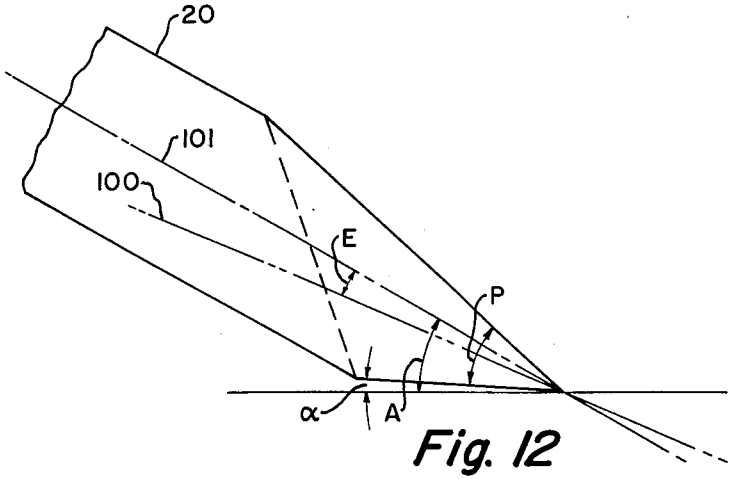

FIGS. 8 9 and 10 illustrate three different embodiments of the digging bar for use in the hearth cleaning apparatus for the present invention; and FIGS. 11, 12 and 13 illustrate the operation and construction of a digging bar with an eccentrically, cone-shaped end.

Figure 1:
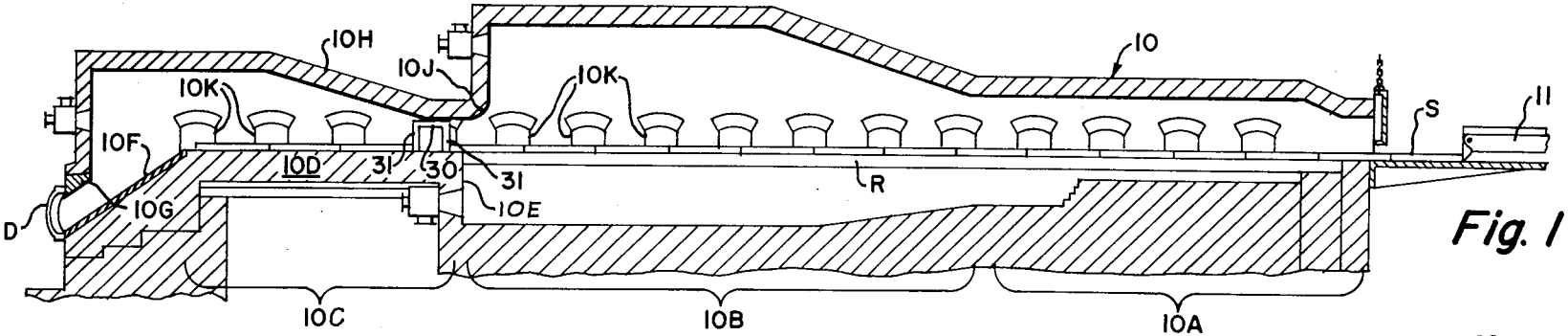
FIGS. 1 and 2 are elevational views, in section, of two known forms of a continuous reheat furnace for slab-like workpieces and illustrating the use of a spacer member to expose the furnace hearth between adjacent workpieces for the removal of adhered slag.
Figure 2:
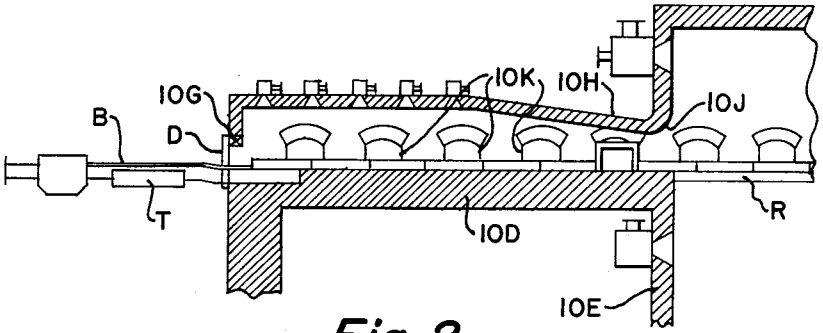

In FIG. 1, there is illustrated a continuous slab-type reheat furnace 10 which includes a slab pusher 11 adapted to engage the sides of a slab S and push it into the furnace. In some furnaces, the pusher advances the entire load of slabs within the furnace along the slab support surface. The furnace illustrated in FIG. 1 is of typical well-known construction and includes water-cooled skids or rails R on which the slabs are carried through the portions of the furnace which are underfired. The water-cooled skids are located in a preheat zone 10A and a heating zone 10B. The soaking zone 10C of the furnace is provided with a refractory hearth 10D which extends from the bottom burner wall 10E in the furnace heating zone 10B to the downwardly-inclined skids 10F used to conduct the heated slabs onto a furnace table. FIG. 2 illustrates a more recent design of a reheat furnace wherein a slab or other workpiece is removed from the soaking zone 10C by mechanical extractor arms B. After these arms are moved into recesses below the slab, they lift the slab and carry it from the furnace to be deposited on a roller table T.

In the end walls of the furnaces shown in FIGS. 1 and 2 above each door D, there is a water-cooled lintel 10G. Two critical areas in these furnaces that are particularly susceptible to damage due to the accumulation or build-up of slag on the furnace hearth are the soaking zone roof 10H and the water-cooled lintel 10G. Both of these parts in the furnaces form restricted passageways that may be damaged when a slab becomes upended or otherwise improperly oriented so that it fails to travel in its normal path. As described hereinafter, slag accumulates on the hearth of the soaking zone just below the soaking zone nose 10J because the outer surface of the slab is "superheated" as previously described. Therefore, slag on the outer surface of the slab becomes plastic or even fluid. The slag is easily transferred to the hearth where it is chilled by a relatively cooler hearth. The inclined relation of the skids 10F relative to the hearth is clearly apparent in FIG. 1. It will also be apparent from FIGS. 1 and 2 that the build-up of slag at the junction of the hearth and the skids will cause erratic movement of a slab whereby it will fail to freely pass through the discharge opening at the door and strike the water-cooled lintel 10G. The apparatus of the present invention is particularly useful to remove adhered slag from the furnace hearth in the soaking zone.

As will be seen in FIGS. 1 and 2, the reheat furnaces include openings 10K at spaced intervals along along their lengths. These openings are each normally closed by an individually removable door. As clearly shown in FIG. 3, the hearth cleaning apparatus of the present invention includes a car 12 having a T-shaped frame 13 which is latched by a hook 14 to the side wall of the furnace.

Figures 3, 5, 6:
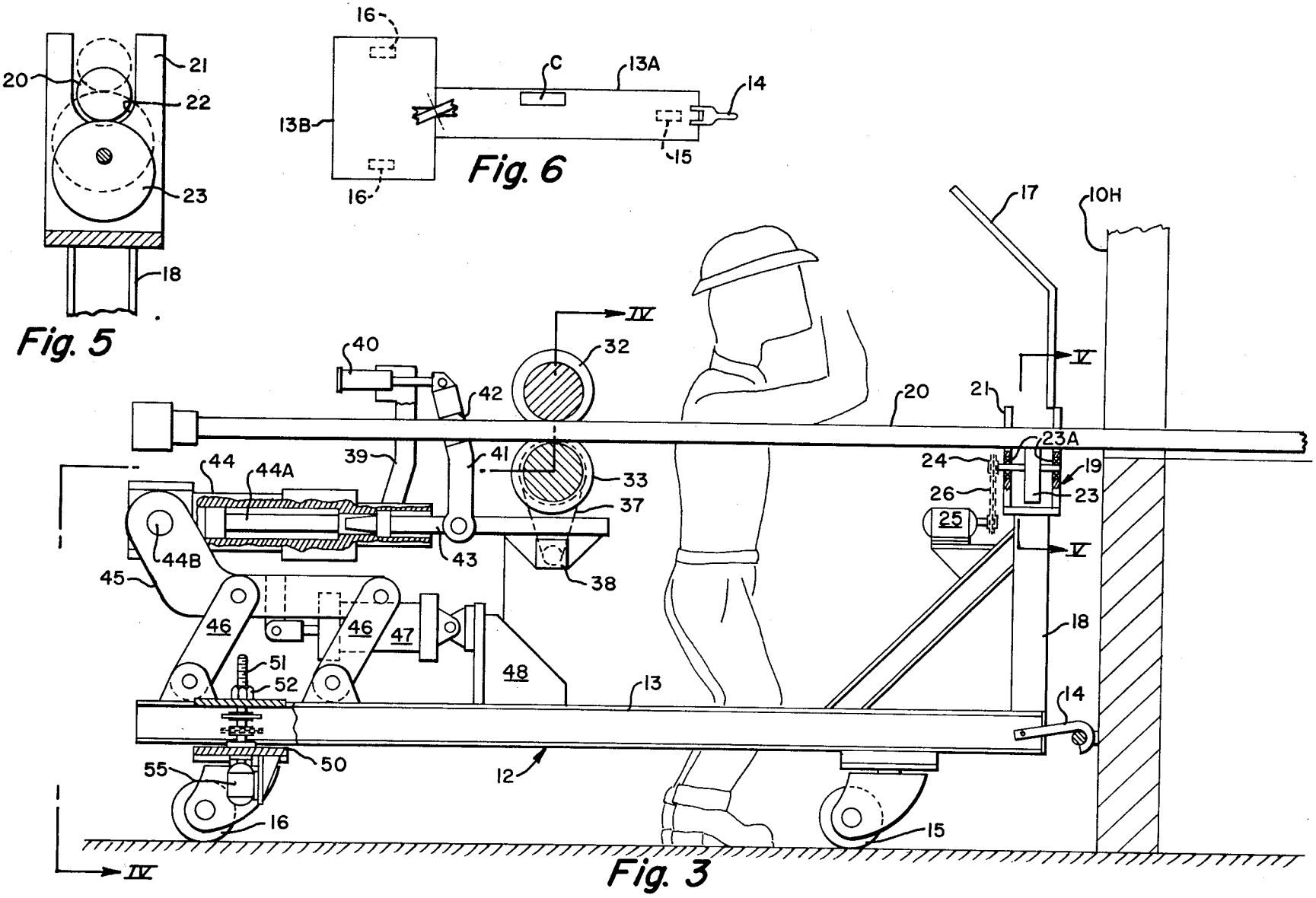
FIG. 3 is an elevational view of the hearth cleaning apparatus according to the present invention.
FIG. 5 is a sectional view taken along line V—V of FIG. 3.
FIG. 6 is a plan view of the main frame structure of the hearth cleaning apparatus of the present invention.

FIG. 6 best illustrates the T-shaped frame which includes a central tongue portion 13A that carries the hook 14 at its extended end where the frame is also supported by a caster-type wheel 15. Two spaced-apart caster-type wheels 16 support the rear portion 13B of the T-shaped frame. The employment of the T-shaped frame has the advantage that it enables an operator, generally depicted in FIG. 3, to position himself closely adjacent the central tongue portion 13A whereby such an operator has a relatively unobstructed line of sight into the furnace to exercise control of the digging operation while protected by a screen 17 that forms a radiation shield against hot gases and direct thermal radiation from the furnace. The shield 17 is supported by a vertical beam 18 that extends from the tongue portion 13A. At the upper end of the beam 18, a vernier adjustment device 19 supports a digging bar 20.

The details of the construction of the digging bar will be described in greater detail hereinafter. The vernier adjustment device 19 is illustrated in FIGS. 3 and 5 and includes a U-shaped retainer plate 21 that forms a recess or pocket 22 into which the digging bar is received. At the bottom edge of the pocket, a cam 23 forms the actual support surface for the digging bar. The cam is supported by a shaft carried by bearings 23A at its opposite ends. A sprocket 24 is secured to one end of the shaft outward of the bearing. A pneumatically-powered motor 25 is supported by a bracket extending from the beam 18. The motor carries a sprocket on its drive output shaft which is joined with sprocket 24 by a chain 26. A control pulpit C is located on the tongue 13A of the car at a convenient location for access by an operator. The control pulpit includes a valve or other suitable control to energize the pneumatic motor 25 and thereby produces rotation of the cam 23. In this way, the elevation of the digging bar can be adjusted in a vernier manner so that the slag engaging end of the digging bar can be brought into proper registry with adhered slag on the furnace hearth notwithstanding changes to the approach angle of the bar as it is advanced along the hearth. In this regard, it must be remembered that due to the width of the furnace hearth which may reach up to 42 feet in the present-day designs, it is necessary to adjust the angle of attack by the digging bar and to compensate for deflection of the digging bar.

To expose the adhered slag on the hearth so that the digging bar may effect removal or loosening of the slag, a generally U-shaped spacer member, shown in FIGS. 1 and 2, is located in an inverted position between two adjacent slabs as they are advanced through the furnace. Although the spacer member illustrated in FIGS. 1 and 2 may be of any desired construction, it includes a top plate 30 joined at its opposite edge by downwardly-extending legs 31.

Figure 7:
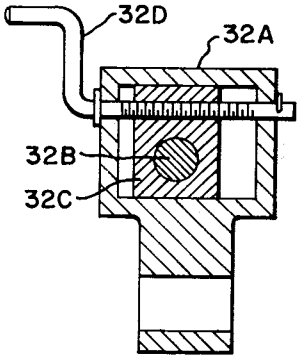
FIG. 7 is a sectional view taken along line VII—VII of FIG. 4.
Figure 4:
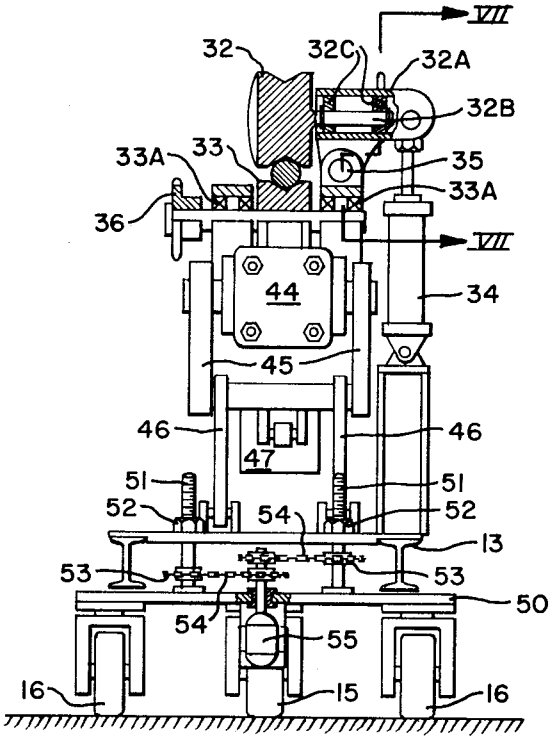
FIG. 4 is a sectional view taken along line IV—IV of FIG. 3.

In view of the foregoing, it will be understood that the digging bar may have a length longer than one-half the width of the furnace hearth and, therefore, a 25–30 foot long digging bar is usually required. In order to propel the digging bar along the furnace hearth into desired locations for slag digging operations, a top pinch roll 32 and a bottom pinch roll 33 are brought into operative engagement with the digging bar as shown in FIGS. 3 and 4. The top pinch roll is rotatably supported by an arm 32A and displaced by a piston and cylinder assembly 34 about a pivot pin 35 to bring the pinch roll 32 into engagement with the upper surface of the digging bar. It is a feature of the present invention to cause the digging bar to rotate about its longitudinal axis while its leading end is advanced along the furnace hearth. This will be explained in greater detail hereinafter in regard to FIGS. 11–13. While the digging bar can be rotated manually by a wrench or the like, it is preferred to controllably position at least one of the pinch rolls in a skewed relation to the other so that they deliver rotating and propelling forces on the digging bar. As shown in FIGS. 4 and 7, the top pinch roll 32 includes a support shaft 32B carried by spaced-apart bearing blocks 32C within a recess in arm 32A. Arm 32A rotatably supports two crankshafts 32D, each having threaded shafts received in a threaded bore formed in a bearing block 32C. By rotating the crankshaft in opposite directions, the top pinch roll is displaced into a skewed relation with the bottom pinch roll. The bottom pinch roll 33 is secured to a shaft which is supported by bearings 33A. A sprocket 36 is secured to an extended end of the shaft of the pinch roll and coupled by a chain 37 to a pneumatic motor 38. The pneumatic motor is supported by a bracket carried by the frame 13. This bracket also includes an extended arm 39 that supports trunnions of a piston and cylinder assembly 40.

The rod end of the piston and cylinder assembly 40 is coupled to a gripper arm 41 having an opening 42 that may include serrated edges to enhance the establishment of a gripping relation with the digging bar 20. The lower end of the arm 41 is coupled to a rod 43 which is the force output member of a pneumatically-powered hammer 44. The pneumatic hammer 44 is of well-known construction and includes a reciprocating piston 44A that moves to and fro in the cylinder by compressed air controlled by a diaphragm valve, not shown. The pneumatic cylinder is mounted by trunnions 44B to a support link 45 that is, in turn, supported by parallel arms 46 on the frame 13. The support link 45 includes a bracket coupled to the rod end of a piston and cylinder assembly 47 that is, in turn, mounted by trunnions to a bracket 48 extending from the frame 13.

The piston and cylinder assembly 47 is operated to position the pneumatic hammer 44 so that it moves along in the same direction which the digging bar is advanced into the furnace during the actual slag digging operation. During the digging operation, when the piston is completely withdrawn into the cylinder thereof, fluid pressure, either automatically or under the control of an operator, is applied to extend the piston out of the cylinder and thereby retracting the pneumatic hammer together with the gripper arm 41 in a direction away from the furnace. Usually during this retracting procedure, the digging bar is held by the pinch rolls against axial movement so that the gripper arm 41 can again engage the digging bar but at a different location along its length. In this way, a 30-foot long digging bar, for example, can receive the hammer blows from the piston and cylinder assembly 44 across one-half of the width of the furnace hearth.

A course adjustment device is provided to displace the digging bar into a desired approximate angle of attack with the slag on the furnace hearth. For this purpose, the caster wheels 16 are supported by a separate subplate 50. The frame 13 is raised or lowered relative to the subplate 50 by two screws 51 that are rotatably held on the subplate 50 and threadedly engaged with stationary nuts 52 welded or otherwise attached to the frame 13. The screws are each coupled by a sprocket wheel 53 through a chain 54 to the drive output shaft of a motor 55. Other forms of elevation adjustment may be provided for the support frame 13.

FIGS. 8, 9 and 10 illustrate three preferred embodiments of a digging bar according to the present invention. In FIG. 8, the digging bar takes the form of a length of pipe 60 or similar tubular member which is adapted for internal water cooling by attaching one end of the pipe to a flange or header 61. A solid digging member 62 is secured to the other end of the pipe 60 in a removable manner. Threads, a bayonet-type joint or other suitable means will permit disengagement of the digging member 62 so that it is replaceable. FIG. 9 illustrates a tubular digging bar 63 coupled at one end to a water supply line 64 and having at its other end, water discharge holes 65 opening out of the working surface 66 of the digging bar. In this embodiment, the digging bar 63 is advanced into the furnace within the space provided by the spacer member 30. Water is then discharged from the digging bar onto the adhered slag to thereby cause thermal cracking of the slag to facilitate its removal. FIG. 10 illustrates a tubularly-shaped digging bar 67 having an additional pipe 68 extending centrally along the digging bar and conducting coolant water to the forwardmost end of the digging bar. The return flow of water cools the digging bar and passes through a discharge pipe 69. In this way, a working face 70 of the digging bar is chilled and when brought into engagement with adhered slag causes thermal cracking thereof. One possible mode to carry out a slag digging operation with the apparatus according to the present invention is to advance the digging bar along the hearth, digging where appropriate, without vernier and course adjustments to the elevation of the digging bar on the car 12. This would normally cause the attack angle A, i.e., the angle between the hearth line and center line of the bar, to continually lessen as the bar is advanced.

As shown in FIGS. 11–13, the working end of the digging bar 20 is cone-shaped in a manner such that the conical axis is non-parallel and eccentric to the longitudinal axis of the digging bar. To achieve the optimum cutting action, it is important to control the relief angle $\alpha$ which is defined as the angle between the hearth line and the bottom edge of the point. This angle represents the difference between the attack angle A and one-half the point angle P.

By forming the point cone so that its center line is skewed to that of the digging bar, the attack angle A can be varied by rotating the bar. In other words, the center line 100 of the cone-shaped end of the digging bar forms an angle E with the longitudinal center line 101 of the digging bar. Thus, the relief angle $\alpha$ may be held constant (and optimum) as the attack angle changes, simply by rotating the bar as it is advanced into the furnace by controlled skewing of the top pinch roll by adjustments to the crankshaft 32D.

In view of the foregoing, it will be understood by those skilled in the art that the use of the hearth cleaning apparatus according to the present invention alleviates the need for workmen to lift and manipulate a heavy digging bar and then attempt a release of the adhered slag by digging operations which may include the requirement for additional personnel to deliver substantial hammer blows to the digging bar. Such use of manual labor is not only undesirable from the cost point of view but more importantly it is ineffective to remove adhered slag from the hearth.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A hearth cleaning apparatus for removing slag and the like adhering to the refractory material forming a furnace hearth used for side-by-side support of elongated metallic workpieces while they are advanced through the furnace to undergo heating for processing in a rolling mill or the like, said furnace including door members normally closing spaced-apart openings in a side wall of the furnace adjacent the hearth thereof, said hearth cleaning apparatus including, in combination, an elongated digging bar including an internal coolant passageway communicating with a coolant discharge opening in a slag digging surface at the end of the bar adapted to extend through at least one of said openings in a side wall of the furnace for contact with adhered slag on a support surface for workpieces in the furnace while producing a cracking of the slag due to chilling by the discharged coolant, a car adapted to move along a side wall of the furnace to support said digging bar while extending into the furnace, and impact means carried by said car and coupled to said digging bar for delivering a propelling force to said digging bar to mechanically loosen slag adhered to workpiece support surfaces in the furnace.

2. The apparatus according to claim 1 further comprising spacer means insertable between two adjacent workpieces for exposing the slag adhered to a hearth of the furnace during operation thereof.

3. The apparatus according to claim 2 wherein said spacer means includes a top spacer plate joined with spaced-apart legs extending downwardly along the length thereof to define an inverted U-shaped spacer.

4. The apparatus according to claim 1 wherein said car includes a T-shaped frame having an extended central tongue defining an operator's station at one side thereof, means carried by the extended end of the central tongue for releasably coupling said car to said furnace at said one of said openings in the side wall thereof, and wheels supporting said frame for movement along the side wall of said furnace.

5. The apparatus according to claim 1 wherein said car includes carrier means to support said digging bar for longitudinal displacement along the car and into the furnace.

6. The apparatus according to claim 1 further comprising adjustable means extending from said car into a supporting relation with said digging bar for vernier elevation adjustments of the digging bar relative to a workpiece supporting hearth of the furnace.

7. The apparatus according to claim 1 further comprising adjustable means for controlling the angular relation between said digging bar and a workpiece supporting hearth of the furnace.

8. The apparatus according to claim 1 wherein said impact means includes a force output member and a pneumatic cylinder having a reciprocating piston therein adapted to develop hammer blows upon said force output member, and means for releasably coupling said force output member to said elongated digging bar.

9. The apparatus according to claim 8 wherein said means for coupling the pneumatic cylinder to said digging bar includes a clamping arm having an annular opening therein which exceeds the cross-sectional size of the digging bar, and means for urging the clamping arm into an engaging relation with the digging bar for the transmission of hammer blows from said reciprocating piston to the digging bar.

10. The apparatus according to claim 9 wherein said impact means further includes a position control cylinder for moving said pneumatic cylinder along said car in the direction generally parallel with the digging bar for establishing a clamped relation by the clamping arm with said digging bar at spaced-apart locations along the length of the digging bar.

11. The apparatus according to claim 1 further comprising means carried by said car to displace said elongated digging bar in the direction of the longitudinal axis thereof.

12. The apparatus according to claim 11 wherein said slag digging surface on the end of said elongated digging bar is further defined to include a cone-shaped slag engaging end which is formed such that the axis of the cone lies in a non-parallel relation with the longitudinal axis of the digging bar.

13. The apparatus according to claim 12 wherein said means carried by said car is further defined to include a pair of pinch rolls, means for rotatably supporting said pinch rolls, and means to adjustably position one pinch roll into a skewed relation with the other pinch roll for rotating said digging bar while the pinch rolls propel the digging bar along the hearth of said furnace.

14. The apparatus according to claim 12 further comprising means to rotate said elongated digging bar about the longitudinal axis thereof to adjust the attack angle formed between said longitudinal axis and the hearth of said furnace.

15. A hearth cleaning apparatus for removing slag and the like adhering to the refractory material forming a furnace hearth used for side-by-side support of elongated metallic workpieces while they are advanced through the furnace to undergo heating for processing in a rolling mill or the like, said furnace including door members normally closing spaced-apart openings in a side wall of the furnace adjacent the hearth thereof, said hearth cleaning apparatus including, in combination, an elongated digging bar adapted to extend through at least one of said openings in a side wall of the furnace for contact with adhered slag on support surfaces for workpieces in the furnace, a car adapted to move along a side wall of the furnace to support said digging bar while extending into the furnace, said car including a T-shaped frame having an extended central tongue defining an operator's station at one side thereof, means carried by the extended end of the central tongue for releasably coupling said car to said furnace at said one of said openings in the side wall thereof, wheels supporting said frame for moving along the side wall of said furnace, and impact means carried by said car and coupled to said digging bar for delivering a propelling force to said digging bar to mechanically loosen slag adhered to workpiece support surfaces in the furnace.

16. The apparatus according to claim 15 wherein said car includes carrier means to support said digging bar for longitudinal displacement along the car and into the furnace.

17. The apparatus according to claim 15 wherein said impact means includes a force output member and a pneumatic cylinder having a reciprocating piston therein adapted to develop hammer blows upon said force output member, and means for releasably coupling said force output member to said elongated digging bar.

18. The apparatus according to claim 17 wherein said means for coupling the pneumatic cylinder to said digging bar includes a clamping arm having an annular opening therein which exceeds the cross-sectional size of the digging bar, and means for urging the clamping arm into an engaging relation with the digging bar for the transmission of hammer blows from said reciprocating piston to the digging bar.

19. The apparatus according to claim 18 wherein said impact means further includes a position control cylinder for moving said pneumatic cylinder along said car in the direction generally parallel with the digging bar for establishing a clamped relation by the clamping arm with said digging bar at spaced-apart locations along the length of the digging bar.

20. The apparatus according to claim 19 further comprising means carried by said car to displace said elongated digging bar in the direction of the longitudinal axis thereof.

21. The apparatus according to claim 20 wherein said elongated digging bar is further defined to include a cone-shaped slag engaging end which is formed such that the axis of the cone lies in a non-parallel relation with the longitudinal axis of the digging bar.

22. The apparatus according to claim 21 wherein said means carried by said car is further defined to include a pair of pinch rolls, means for rotatably supporting said pinch rolls, and means to adjustably position one pinch roll into a skewed relation with the other pinch roll for rotating said digging bar while the pinch rolls propel the digging bar along the hearth.

23. The apparatus according to claim 21 further comprising means to rotate said elongated digging bar about the longitudinal axis thereof in a manner to adjust the attack angle formed between said longitudinal axis and the hearth of said furnace.

24. The apparatus according to claim 15 further comprising support means extending vertically from said T-shaped frame adjacent the forward end of said car when positioned adjacent the side wall of said furnace, and adjustment means carried by said support means for vernier elevation adjustments of said digging bar.

25. The apparatus according to claim 15 further comprising means for adjusting the elevation of said frame and thereby the digging bar supported thereby to change the angle of attack by said digging bar relative to slag adhered to a hearth to support a workpiece in the furnace.

26. A hearth cleaning apparatus for removing slag and the like adhering to the refractory material forming a furnace hearth used for side-by-side support of elongated metallic workpieces while they are advanced through the furnace to undergo heating for processing in a rolling mill or the like, said furnace including door members normally closing spaced-apart openings in a side wall of the furnace adjacent the hearth thereof, said hearth cleaning apparatus including, in combination, an elongated digging bar adapted to extend through at least one of said openings in a side wall of the furnace for contact with adhered slag on support surfaces for workpieces in the furnace, a car adapted to move along a side wall of the furnace to support said digging bar while extending into the furnace, a pneumatic cylinder including a reciprocating piston carried by said car for delivering a propelling force to said digging bar to mechanically lossen slag adhered to workpiece support surfaces in the furnace, means including a clamping arm having an annular opening therein which exceeds the cross-sectional size of the digging bar for transmitting the propelling force from the reciprocating piston of said pneumatic cylinder to said digging bar, and means for urging said clamping arm into an engaging relation with the digging bar for transmission of hammer blows from said reciprocating piston to said digging bar.

27. The apparatus according to claim 26 further including a position control cylinder for moving said pneumatic cylinder along said car in the direction generally parallel with the digging bar for establishing a clamped relation by said clamping arm with said digging bar at spaced-apart locations along the length of the digging bar.

28. The apparatus according to claim 26 further comprising means carried by said car to displace said elongated digging bar in the direction of the longitudinal axis thereof.

29. The apparatus according to claim 26 wherein said elongated digging bar includes a cone-shaped slag engaging end which is formed such that the axis of the cone lies in a nonparallel relation with the longitudinal axis of the digging bar.

30. The apparatus according to claim 29 further including a pair of pinch rolls, means carried by said car for rotatably supporting said pinch rolls, and means to adjustably position one pinch roll into a skewed relation with the other pinch roll for rotating said digging bar while the pinch rolls propel the digging bar along the hearth of said furnace.

31. The apparatus according to claim 29 further comprising means to rotate said elongated digging bar about the longitudinal axis thereof to adjust the attack angle formed between said longitudinal axis and the hearth of said furnace.

32. A hearth cleaning apparatus for removing slag and the like adhering to the refractory material forming a furnace hearth used for side-by-side support of elongated metallic workpieces while they are advanced through the furnace to undergo heating for processing in a rolling mill or the like, said furnace including door members normally closing spaced-apart openings in a side wall of the furnace adjacent the hearth thereof, said hearth cleaning apparatus including, in combination, an elongated digging bar adapted to extend through at least one of said openings in a side wall of the furnace for contact with adhered slag on support surfaces for workpieces in the furnace, a car adapted to move along a side wall of the furnace to support said digging bar while extending into the furnace, impact means carried by said car and coupled to said digging bar for delivering a propelling force to said digging bar to mechanically loosen slag adhered to workpiece support surfaces in the furnace, a pair of pinch rolls, means carried by said car for rotatably supporting said pinch rolls, and means to adjustably position one pinch roll into a skewed relation with the other pinch roll for rotating said digging bar while the pinch rolls propel the digging bar along the hearth of said furnace.

33. The apparatus according to claim 32 wherein said digging bar includes an internal passageway coupled to means for conducting coolant along the length thereof.

34. The apparatus according to claim 32 wherein said digging bar includes a cone-shaped slag engaging end which is formed such that the axis of the cone lies in a non-parallel relation with the longitudinal axis of the digging bar.

35. The apparatus according to claim 32 wherein said digging bar further includes a water supply line and a water return line coupled to the digging bar at one end thereof opposite said slag engaging end.

* * * * *